United States Patent [19]

Shimada et al.

[11] Patent Number: 4,557,769

[45] Date of Patent: Dec. 10, 1985

[54] SOFT MAGNETIC MATERIAL

[75] Inventors: Yutaka Shimada, Sendai; Koichi Mukasa, Niigata; Takashi Hatanai, Niigata; Keishi Nakashima, Niigata, all of Japan

[73] Assignee: Alps Electric Co., Ltd.

[21] Appl. No.: 630,897

[22] Filed: Jul. 16, 1984

[30] Foreign Application Priority Data

Jul. 16, 1983 [JP] Japan ..... 58-128712

[51] Int. Cl.[4] ..... H01F 1/04

[52] U.S. Cl. ..... 148/31.55; 148/403; 420/435

[58] Field of Search ..... 148/31.55, 403; 420/435

[56] References Cited

U.S. PATENT DOCUMENTS 3,856,513 12/1974 Chen et al. ..... 75/122
4,473,417 9/1984 Inomata et al. ..... 148/403

FOREIGN PATENT DOCUMENTS 0105137 4/1984 European Pat. Off. ..... 148/121
58-34156 2/1983 Japan ..... 148/31.55

*Primary Examiner*—John P. Sheehan
*Attorney, Agent, or Firm*—Guy W. Shoup

[57] ABSTRACT

A soft magnetic material having a low coercive force and a high permeability without reduction in saturation magnetic flux density is composed of a Co-base Co-Hf-Ta amorphous alloy containing 1 to 5 atoms % Hf and 4 to 10 atoms % Ta. The amorphous alloy is prepared by sputtering, etc.

3 Claims, 3 Drawing Figures

SOFT MAGNETIC MATERIAL

FIELD OF THE INVENTION

This invention relates to a soft magnetic material having a high permeability and, more particularly, to a soft magnetic material composed of an amorphous alloy.

BACKGROUND OF THE INVENTION

Hitherto, various kinds of materials have been investigated and proposed as soft magnetic materials and soft magnetic materials having various properties have been developed. For example, there are binary permalloy composed of an iron-nickel alloy and ternary or other permalloy composed of the iron-nickel alloy and a third element such as chromium, molybdenum, copper, etc. However, in permalloy, it is difficult to sufficiently increase the permeability and saturation magnetic flux density.

SUMMARY OF THE INVENTION

As the result of various investigations on amorphous alloy thin layer obtained by sputtering, etc., the inventors have discovered that a cobalt-hafnium-tantalum ternary alloy mainly composed of cobalt and containing hafnium and tantalum, wherein the content of said hafnium is from 1 atom % to 5 atom %, preferably from 1.5 atom % to 3 atom % and the content of said tantalum is from 4 atom % to 10 atom %, preferably from 6 atom % to 8 atom %, has excellent properties as a soft magnetic material.

That is, the invention provides a soft magnetic material comprising a cobalt-base ternary amorphous alloy containing hafnium and tantalum, wherein the content of said hafnium is in the range of from 1 atom % to 5 atom % and the content of said tantalum is in the range of from 4 atom % to 10 atom %.

DESCRIPTION OF THE PREFERRED EMBODIMENT

A crystal glass is used as a base plate and pellets of hafnium and pellets of tantalum (each pellet having 10 mm×10 mm in area and 5 mm in thickness) are alternately disposed on a cobalt disk (101.6 mm in diameter and 5 mm in thickness) radially from the center of the disk, whereby the composition of the alloy formed on the base plate by sputtering can be changed by controlling the number of the pellets on the target. Then, a chamber containing the foregoing system is evacuated to high vacuum of lower than $1\times10^{-6}$ Torr and sputtering is performed in an argon gas atmosphere at a high frequency electric power of 2.0 watts/cm$^2$ to form a cobalt-base Co-Hf-Ta ternary amorphous alloy on the base plate. The amorphous alloys having various compositions formed as above described are used for various property tests as set forth hereinafter.

Figure 1:
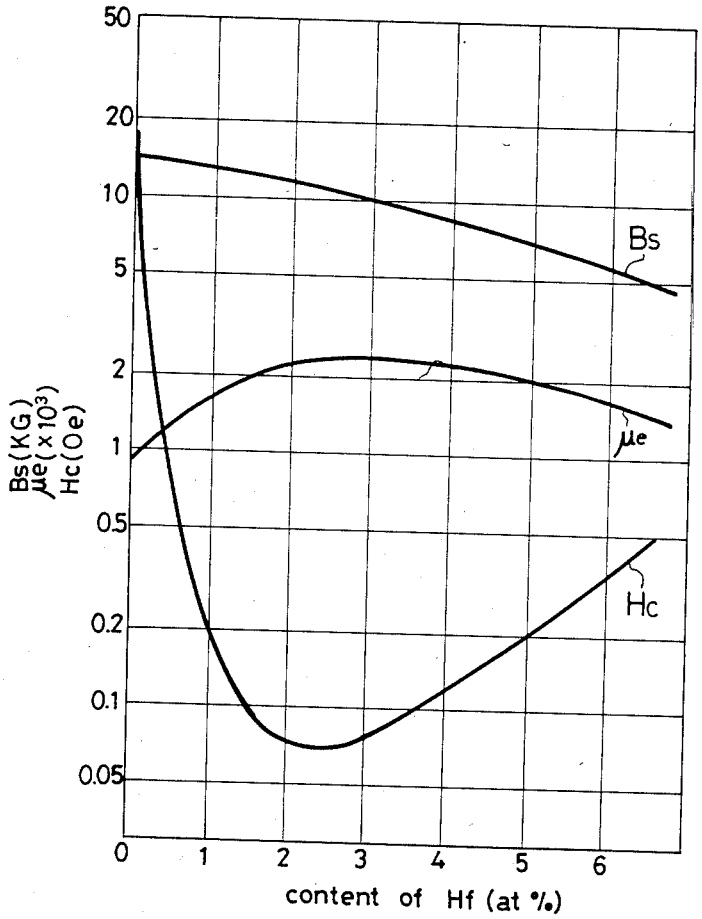
FIG. 1 is characteristic graph showing the relation between the content of Hf in the Co-Hf-Ta amorphous alloy of this invention and various magnetic properties.

FIG. 1 is a magnetic characteristic graph in the case of changing the content of X of hafnium in the alloy in the alloy composition table shown below while always keeping the content Y of Ta in the alloy at 4.5 atom %.

| Alloy composition table | |
|---|---|
| Co | 100-X-Y atom % |
| Hf | X atom % |
| Ta | Y atom % |

In addition, in the graph of FIG. 1, the curve Bs shows a saturation magnetic flux density, the curve $\mu_3$ a permeability in a sparingly magnetizable axis direction at a frequency of 1 MHz, and the curve Hc a coercive force in the sparingly magnetizable axis direction.

As is clear from the graph, the Co-Ta binary alloy containing no Hf has high Bs but is too high in Hc and low in $\mu_e$. However, when a small amount of Hf is present in the alloy, Hc greatly decreases, while $\mu_e$ increases in contrast with this. In addition, when the content of Hf is over a certain level, Hc becomes high and $\mu_e$ becomes low. On the other hand, Bs tends to decrease with the increase of the content of Hf although the decreasing extent is not so extreme.

In order to decrease Hc and increase $\mu_e$ without reducing Bs too much, it is necessary that the content X of Hf be in the range of from 1 atom % to 5 atom %, preferably from 1.5% to 3 atom %. This is also true when the content of Ta is changed to some extent.

Figure 2:
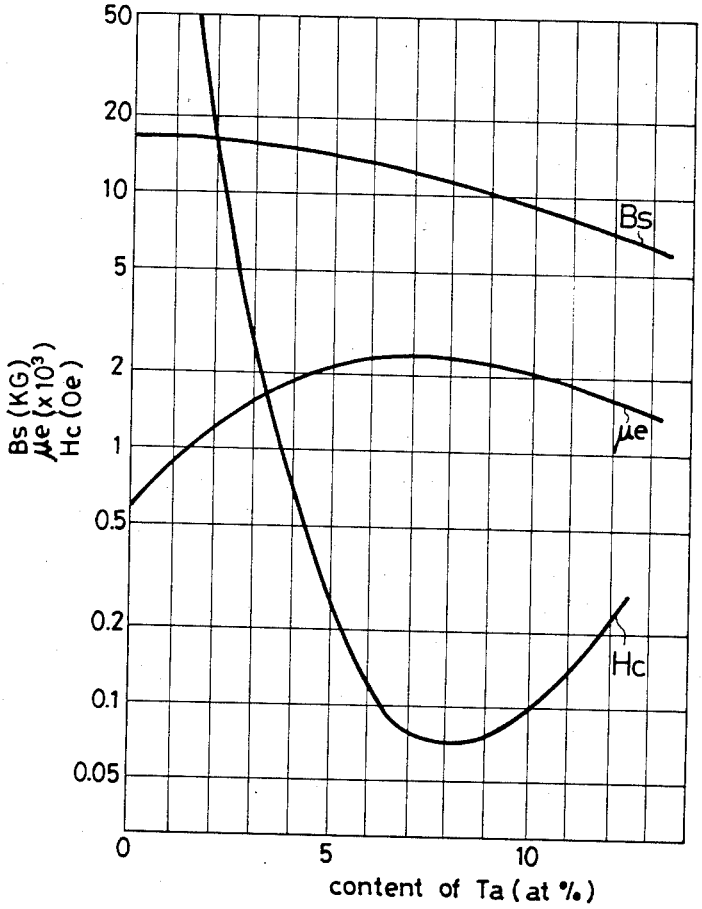
FIG. 2 is a characteristic graph showing the relation between the content of Ta in the foregoing alloy and various magnetic properties.

FIG. 2 is a magnetic characteristic graph showing the case of changing the content Y of Ta in the alloy shown in the foregoing alloy composition table while always keeping the content X of Hf in the alloy at 2.2 atom %.

As is clear from the graph, in a Co-Hf binary alloy containing no Ta, Bs is high but Hc is too high and $\mu_e$ is low as in the foregoing case. However, when a small amount of Ta is present in the alloy, Hc becomes extremely low but $\mu_e$ becomes high in contrast with this. In addition, when the content of Ta is over a certain level, Hc becomes high and $\mu_e$ becomes low. On the other hand, Bs tends to decrease with the increase of the content of Ta although the decreasing extent is not so extreme.

In order to reduce Hc and increase $\mu_e$ without decreasing Bs too much in such a tendency of magnetic properties, it is necessary that the content Y of Ta be in the range of from 4 atom % to 10 atom %, preferably from 6 atom % to 8 atom %. This is also true when the content X of Hf is changed to some extent.

Figure 3:
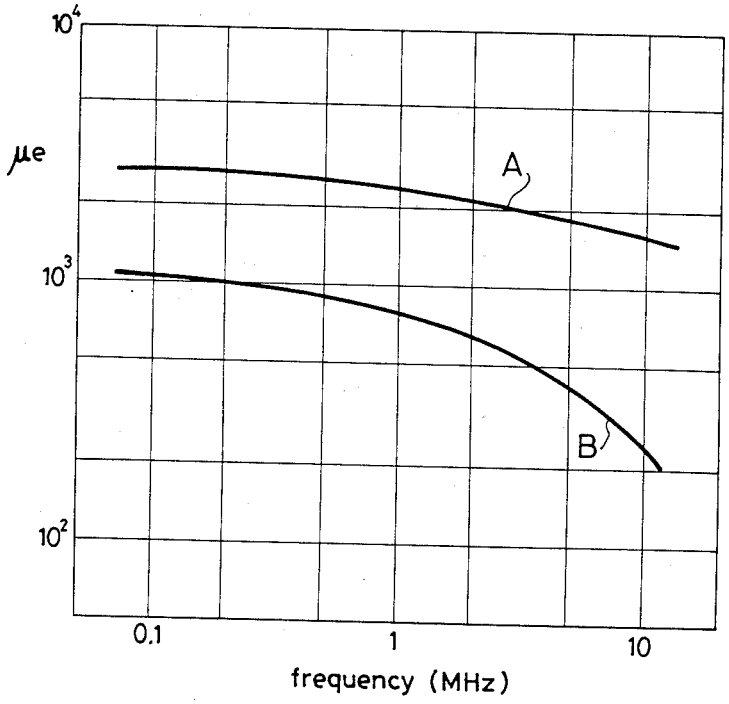
FIG. 3 shows magnetic characteristic curves of the foregoing alloy and a comparison alloy at each frequency.

FIG. 3 is a graph showing $\mu_e$ of a ternary amorphous alloy composed of Co (93.3 atom %), Hf (2.2 atom %), and Ta (4.5 atom %) (Curve A) and $\mu_e$ of a binary amorphous alloy composed of Co (97.8 atom %) and Hf (2.2 atom %) (Curve B) at each frequency.

As is clear from the graph, the soft magnetic material of this invention always has a high permeability at each frequency and shows stable characteristics in a wide frequency range.

Thus, by defining the content of Hf to the range of from 1 atom % to 5 atom % and the content of Ta to the range of 4 atom % to 10 atom % in a Co-base Co-Hf-Ta ternary amorphous alloy, a soft magnetic material having a low coercive force and a high permeability without decreasing a saturation magnetic flux density too much can be provided.

What is claimed:

1. A soft magnetic material consisting of a cobalt-base ternary amorphous alloy containing hafnium and tantalum, the content of said hafnium being from 1 atom % to 5 atom % and the content of said tantalum being from 4 atom % to 10 atom %.

2. The soft magnetic material as claimed in claim 1, wherein the content of said hafnium is in the range of from 1.5 atom % to 3 atom %.

3. The soft magnetic material as claimed in claim 1, wherein the content of said tantalum is in the range of from 6 atom % to 8 atom %.

* * * * *